US005525013A

United States Patent [19]

Seegmiller et al.

[11] Patent Number: 5,525,013

[45] Date of Patent: Jun. 11, 1996

[54] CABLE BOLT STRUCTURE AND RELATED COMPONENTS

[76] Inventors: Ben L. Seegmiller, 143 S. 400 East, Salt Lake City, Utah 84111; John A. Reeves, Jr., 16653 W. Archer Ave., Golden, Colo. 80401

[21] Appl. No.: 332,266

[22] Filed: Oct. 31, 1994

[51] Int. Cl.[6] ..... E21D 21/00

[52] U.S. Cl. ..... 405/259.3; 405/259.4; 405/302.2; 411/82

[58] Field of Search ..... 405/259.1, 259.3, 405/259.4, 288, 302.1, 302.2; 411/8, 82; 23/784

[56] References Cited

U.S. PATENT DOCUMENTS

| | | | |
|---|---|---|---|
| 2,667,037 | 1/1954 | Thomas et al. | 405/259.4 X |
| 3,077,809 | 2/1963 | Harding et al. | 405/302.2 X |
| 4,509,889 | 4/1985 | Skogberg et al. | 405/259.3 X |
| 4,954,017 | 9/1990 | Davis et al. | 405/259.3 |
| 4,984,937 | 1/1991 | Karpellus | 405/259.3 |
| 5,015,125 | 5/1991 | Seegmiller | 405/288 |
| 5,026,217 | 6/1991 | Seegmiller | 405/288 |
| 5,215,411 | 6/1993 | Seegmiller | 405/288 |
| 5,230,589 | 7/1993 | Gillespie | 405/259.6 |
| 5,259,703 | 11/1993 | Gillespie | 405/259.6 |
| 5,375,946 | 12/1994 | Locotos | 405/259.4 |
| 5,378,087 | 1/1995 | Locotos | 405/302.2 X |
| 5,441,372 | 8/1995 | Wilkinson | 405/259.5 X |
| 5,458,442 | 10/1995 | Ashmore | 405/259.5 X |

OTHER PUBLICATIONS

Design of Cable Bolt Supports for Underground Coal Mines, Proc., 33 Page Short Course Dev. by Col. of Eastern Utah & USBM, Price, UT (May 1994).

Koch, R. L. Application of Cable Bolt Supports at West Elk Mine, Technical Paper Ltd May 26, 1994 (7 p.).

Bawden, W. F. & Archibald, J. F. Ed, Innovative Mine Design For the 21$^{ST}$ Century, Proc. Int. Cong. on Mine Design (pp. 1001–1008) Kingston, Ontario, Canada (Aug. 1993).

Todolini., SC. & Koch, R. L., Cable Supports for Improved Longwall Gateroad Stability, 12$_{Th}$ Conf. on Ground Control in Mining (Undated) (pp. 9–15) Cited by Applicant p. 1 of 2.

Goris, J. M., Laboratory Evaluation of Cable Bolt Supports, RI 9308, USBM (1990) 23 p.

*Primary Examiner*—Roger J. Schoeppel
*Attorney, Agent, or Firm*—M. Ralph Shaffer

[57] ABSTRACT

Cable bolt structure, related components and method related to the support, in active and passive modes, of mine roof strata for achieving desired ground control.

1 Claim, 14 Drawing Sheets

CABLE BOLT STRUCTURE AND RELATED COMPONENTS

FIELD OF INVENTION

The present invention relates to cable bolt structures and related components for use in underground mines, useful in ground control as to mine roof strata disposed over a mine opening.

DESCRIPTION OF PRIOR ART INCLUDING BRIEF HISTORY OF CABLE BOLT SUPPORTS

The present invention contemplates the usage of epoxy-coated, corrosion resistant multi-strand cable. In the past cable bolt supports have been used extensively, both here and abroad, in underground mines for achieving ground control in mine roof strata. Cable bolts in general have shown great versatility in many mining techniques and have high load-carrying capacities in addition to being cost effective. The trend in present day mining is to favor cable bolts over the employment of a rebar or other bar-type bolts.

A rebar or rod bolt may tend to fail and even break in shear when a lateral shift occurs in mine strata. Lateral movement is often present in mine strata. Multi-strand cable on the other hand, when installed as a roof bolt, for example, will tend to give and slightly alter deformation even though ground shift has occurred; yet, the anchor of the cable bolt remains intact. The holes drilled in strata and provided for the cable bolts should be very much longer than those customarily supplied with rod type anchor bolts.

Heretofore, many types of cable bolts have had swaged or crimped end fittings. These often will fail under increased tensile loading.

In past engineering practices as well as present in the invention herein, the length to which cable bolt supports are embedded in mine strata is important, because the load-carrying capacity of the bolt will depend upon the pullout resistance per unit length of the embedded cable. A standard term has come into use, namely, "critical embedment length," which is the required embedment length of a cable bolt to support a given rock mass. Pullout resistance of course depends upon such factors as resin system strength, cable geometry, rock strength, and so forth. As to the application of cable bolt supports in underground coal mines, for example, these cables can be point anchored as by a mixed resin system, by mechanical split anchor, and so forth; in hardrock mines the cables can be fully grouted in place. These cables or cable bolts utilize bearing plates and anchors on the ends of the cables extending out of the drill holes.

Again, cable bolts are anchored at the top using a resin grout; these have nuts or other structure which thrust against and bearing plates which hold in place the customary mats disposed over a mine roof mesh support, by way of example.

One type of cable which is very satisfactory for use in the present cable bolts is manufactured by the Sumiden Wire Products Corporation of Stockton, Calif., and known as PC strand grade 270. The cable has a central kingwire and 5–6 strands wrapped thereabout. Where the diameter of its transverse cross section is 0.6 inches, by way of example, the cross sectional area of the cable strand is of the order of 0.218 inches which has an ultimate tensile strength of 60,500 pounds and a yield strength at 1% extension of 53,700 pounds, with a modulus of elasticity of $28.0\times10^6$ psi.

Cable bolts have proven extremely effective in supporting the mine roof and have advantages over some other types of supports because their anchorage is quick, because of employment of a quick setting resin at its upper extremity, existing drilling equipment can be used, and longer supports can be installed because the cable is flexible and the cable resists horizontal shear forces present in many horizontal bedded deposits.

Additional information on cable bolt supports for underground coal mines, trona mines, as well as hardrock mining installation, reference is made to the following publications:

*Design of Cable Bolt Supports for Underground Coal Mines,* College of Eastern Utah, Price, Utah and the United States Bureau of Mines lecture dated May 26, 1994.

*Application of Cable Bolt Supports at West Elk Mine,* Robert L. Koch, Mountain Coal Company, Somerset, Colo., abstract dated May 26, 1994.

Proceedings of the International Congress on Mine Design, Canada, August 23–26, 1993, *Innovative Mine Design for the 21st Century,* Edited by Bawden and Archibald.

*Cable Supports for Improved Longwall Gateroad Stability,* 12th Conference on Ground Control in Mining, Stephen C. Tadolini and Robert L. Koch.

*Bureau of Mines Report RI* 9308, *Laboratory Evaluation of Cable Bolt Supports,* Report of Investigations 1990, by J. M. Goris, United States Department of the Interior.

Relative to the patent literature, U.S. Pat. Nos. 5,015,125 and 5,215,411 by one of the co-inventors herein, Ben L. Seegmiller, indicate controlled resistance and loading of mine post supports, an operating feature which can be applied to the present cable bolt herein. Other patent literature include two patents issued to Harvey D. Gillespie, U.S. Pat. Nos. 5,230,589 and 5,259,703. Patent '589 teaches the concept, as modified in the present invention, of plural wedge shaped jaws which are internally serrated to grip a composite cable, the gripping action being effected by hexagonal head collar which is frusto-conically tapered as to its interior to receive the jaws and urge the same into griping engagement with the cable as the collar is forced progressively downwardly over the jaws supplied. Patent '703 teaches the employment of buttons supplied the upper end of the cable, useful for mixing the resin thereat, and also a resin or epoxy dam affixed to the cable, for impeding or reducing resin flow downwardly once the resin cartridge is shredded and mixing has occurred.

Past structures and techniques in the engineering field above described have been centered upon passive support wherein the nuts or other end fittings at the lowermost portions of the rods or cable bolts are simply urged against the bearing plates utilized without utilizing a marked production in the tensioning of the cable bolts themselves relative to their point anchors. No art is known, relative to cable bolts, wherein an active support system is used, either principally or optionally, wherein the cable bolts are tensioned to a degree within a desirable operating range of the cable bolts, i.e. from 20,000 to 40,000 pounds, so as to impose compression forces on the mine roof strata and in fact stabilize the strata. Passive systems in contrast, rely upon the progressive dilation of the mine roof surface to produce tension in the bolts or cables. The present invention provides facility for using the unique cable bolt structure, accessories and method herein in both active as well as passive systems.

BRIEF DESCRIPTION OF THE INVENTION

Accordingly, in one form of the present invention a cable bolt structure is employed having a point anchor generally in the form of an epoxy anchor and lowermost structure in the form of a collar and cooperating gripping jaws which grip the lower end of the cable length utilized. In a preferred form of the invention the collar is provided a tubular shaft extension which is outwardly threaded to receive a tension adjustment nut. The tubular shaft proceeds through a bearing plate and upwardly into the hole provided for the mounting of the cable bolt. The nut rests against the bearing plate and, when rotated against the bearing plate, will produce the desired tension in the cable which is held at its upper extremity by the point anchor used. The lower portion of the structure is designed such that the nut can be used to turn the cable bolt structure as the same as thrust upwardly in a spinning action to mix the resin at the upper part of the hole and, additionally, once the cable bolt is set, to supply the necessary tensioning of the cable bolt as may be desired. Thus, a rotation of the nut in one direction will cause a spinning of the cable bolt for epozy mixing, whereas a rotation of the nut in the opposite direction will produce the tensioning desired.

Buttons for epoxy mixing are supplied the cable length used at its upper extremity, and are configured in such a manner that the optimum epoxy mixing will occur. Likewise, a dam element is crimped on the cable underneath the buttons to deter the flow of epoxy from its intended position for use as a point anchor of the cable. The dam element is preferably made of a soft metal that is simply slit at one side thereof; in installation it is crimped onto the cable and held in place by its intercooperating configurement. The structure as briefly described above relays to active systems wherein a substantial tension is applied to the cable bolt, i.e. of the order of 20 to 40 thousand pounds.

The structure can also be modified, e.g. the cable tensioning function removed, so that the structure can be used in passive systems wherein the cable bolts receive wire mesh and support pans held in place by bearing plates and the cable bolt attachments, i.e. nuts.

Relative to active systems, a specially designed cable bolt herein employs a frictional pressure bubble wherein the carrier at the end of the cable has an exterior cylindrical surface which coacts in an interference fit with a tubular member, whereby to slide therewithin so as to maintain cable tension within a desired range even though roof strata tends to settle.

OBJECTS

Accordingly, a principal object of the present invention is to provide a new and improved cable bolt for mine roof strata control.

An additional object is to provide a cable bolt having a telescoping interference fit between elements incorporating a pressure bubble principle, as hereinafter pointed out in detail.

An additional object is to provide a cable bolt which can be employed in either active or passive mine roof support systems.

An additional object is to provide in cable bolt designs epoxy mixing buttons and also an epoxy-flow dam of high efficiency characteristics.

An additional object is to provide cable bolt structure wherein bi-directional rotation of a nut on a threaded shaft employed will be provided to accomplish separate, distinct functions.

An additional object is to provide a pressure bubble feature in a cable bolt so there will be controlled tension and slippage of the bolt within a desired range when the mine roof tends to settle or dilate.

An additional object is to provide a cable bolt mine roof anchor wherein the tightening nut utilized is designed for both the spinning of the cable bolt, to effect epoxy mixing and subsequent anchored securement of the upper end of the bolt within its borehole and also for advance-torquing of the nut for the purpose of tensioning, and also regulating tension produced in such cable bolt, in accordance with strata conditions and the strata control range desired.

BRIEF DESCRIPTION OF DRAWINGS

The features of the present invention, together with further objects and advantages thereof, may best be understood by reference to the following detailed description taken in conjunction with the following drawings and which.

DETAILED DESCRIPTION OF PREFERRED EMBODIMENTS

Figure 1:
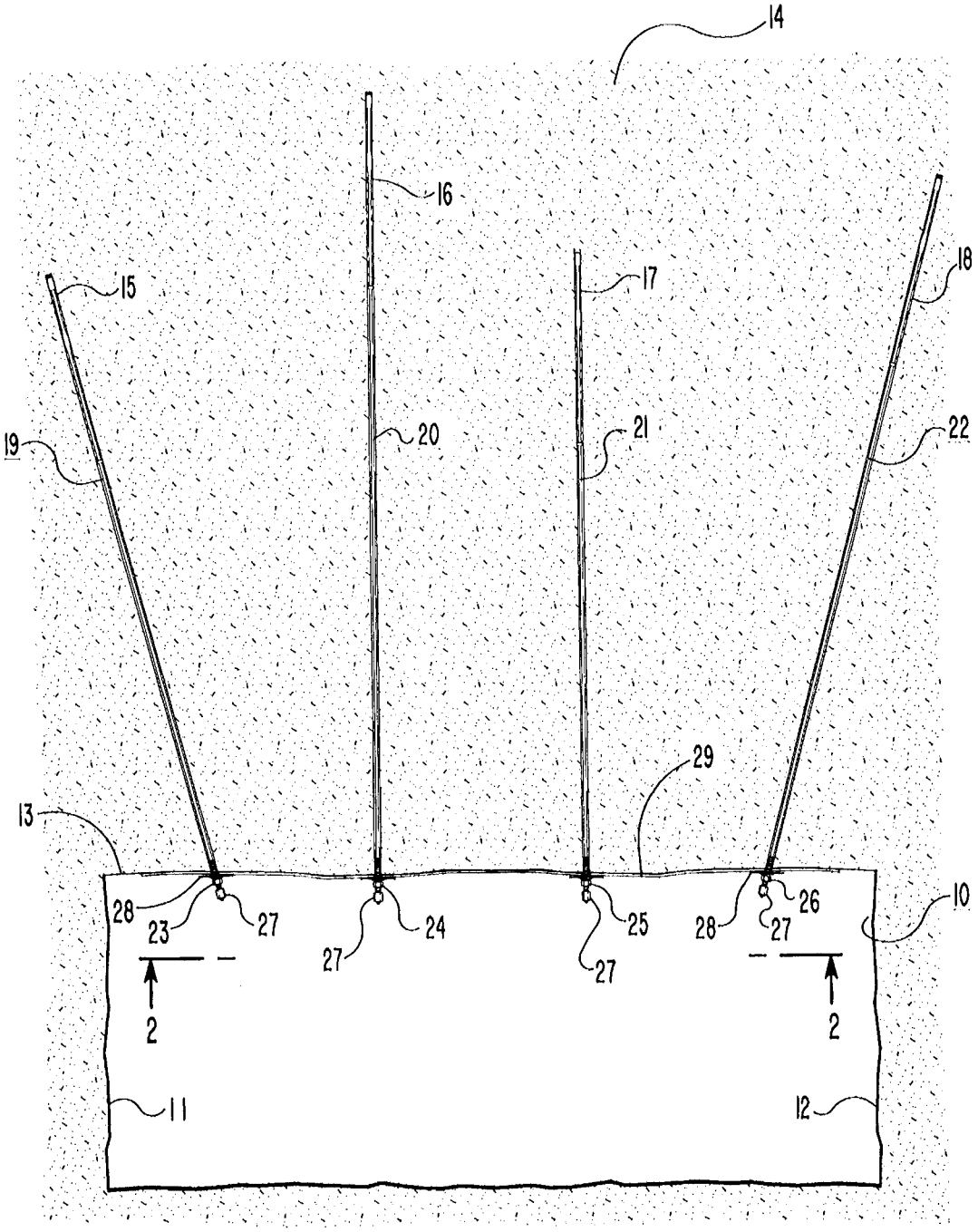
FIG. 1 is an elevation of a mine opening showing mine roof bolts as having been installed.

In FIG. 1 mine roof opening 10 has side ribs 11 and 12 and also a mine roof surface 13 over which will be the mine roof strata 14. Drilled in the mine roof strata 14 is a series of boreholes 15–18 which respectively receive mine roof bolts 19–22 as seen. Mine roof bolts 19–22 in the present invention each take the form of a cable bolt which will be hereinafter described in detail. At this juncture it is sufficient to say that there will be provided for the several mine roof bolts respective tensioning nuts 23–26 which will serve to tension the mine roof bolts after the upper ends are secured in place within the respective boreholes. The mine roof bolts will also include cable securement end fittings 27 which will be described in detail hereinafter. Bearing plates 28 are disposed above the respective nuts 23–26 and are disposed over a roof support mesh 29. To further aid in the support of wire mesh 29 there can be provided a series of roof mats one of which is shown at 31 in FIG. 2. The same will be formed as having a respective base 32 and depending side flanges 33 and 34, forming essentially a channel construction. The side flanges can be simply turned down or be constituted by stamped, V-shaped downwardly projecting ribs or elongated protuberances. The bases of the channels or mats can include a series of apertures as seen at 35. Accordingly, in installation the mesh is first tacked in place over the roof surface of the mine roof strata. Subsequently, a succession of mats will be disposed thereover and tightly secured in place, and then a series of boreholes as at 15–18 in FIG. 1 will be drilled into the roof strata through respective ones of apertures 35. The bearing plates 28 will be disposed in place over the lower ends of the mine roof bolts which will have been epoxy-anchored at the upper portions of the respective boreholes 15–18. Nuts 23 threadedly engage the threaded ends of the mine roof bolts and are torqued to a desired level for tensioning the mine roof bolts in the manner desired.

Figure 3:
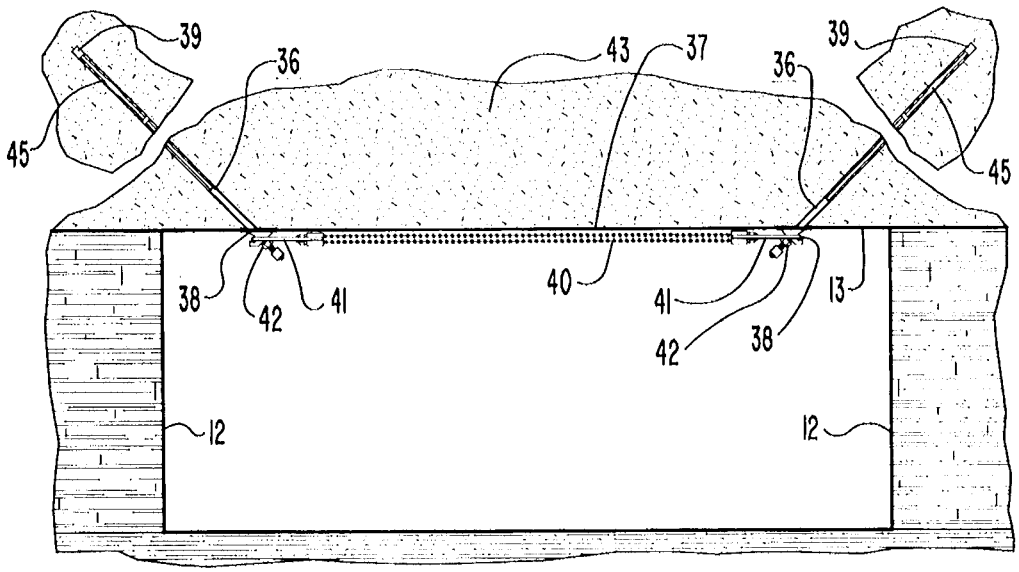
FIG. 3 is a front elevation of a mine opening showing cable bolts anchoring mine roof brackets, the latter being coupled together by tie rod structure.

In FIG. 3 the mine roof bolts (elements 19–22 in FIG. 1) now individually take the form of a pair of cable bolts 36 disposed at opposite sides of mine roof span 37. Brackets 38, such as those shown in U.S. Pat. No. 5,026,217 which is fully incorporated by way of reference herein, will be supplied and will receive at their respective angulated apertures, not shown, the cable bolts 36 the upper ends of which will be anchored by epoxy or other means at their upper, outermost ends 39. For supporting the mine roof span 37 there can be provided a tie rod 40 having stirrup connectors 41, see again U.S. Pat. No. 5,026,217, which loop about brackets 38. These stirrups can be tightened as per the above patent reference and the cable bolts tensioned by their respective nuts 42 so that the mine roof strata at 43 is placed in compression and thus stabilized.

Figure 4:
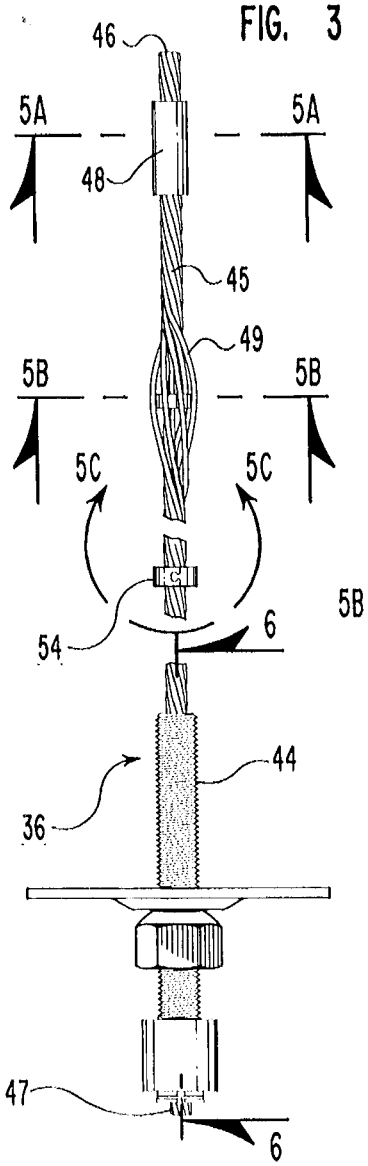
FIG. 4 is a front elevation, shown partly broken away, of a cable bolt structure as is contemplated and utilized in the present invention.

Relative to the installations both in FIG. 1 and FIG. 3, the cable bolt 36, e. g., can take the form as that seen in FIG. 4. Thus, a cable 45 is supplied, having upper end 46 and lower end 47. For the purpose of epoxy mixing, i. e. for the purpose of securing the upper end of the cable bolt within its respective borehole, there may be provided a respective sleeve element 48, a "birdcage" enlarged section 49, and an epoxy-flow dam element as at 54.

Figure 5A:
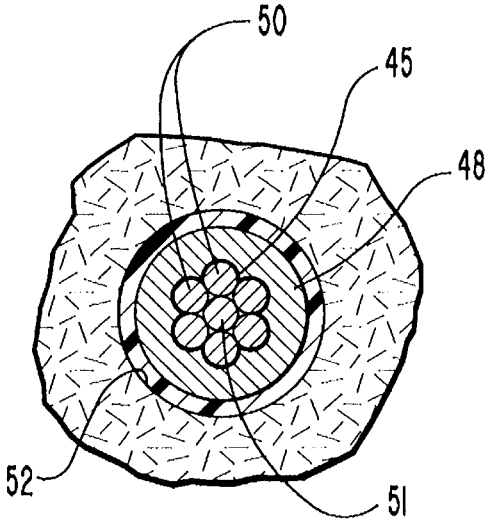
FIG. 5A is an enlarged detail taken along the section line 5A—5A in FIG. 4.

FIG. 5A illustrates that the cable 45 may comprise a series of cable strands 50 which are wrapped in helical fashion about a central kingwire 51. Element 48 is crimped or otherwise secured over the cable length as seen in FIG. 5A, and the same will be dimensioned such that there will be at least a small spacing between the exterior of element 48 and the interior surface 52 of the borehole.

Figure 5B:
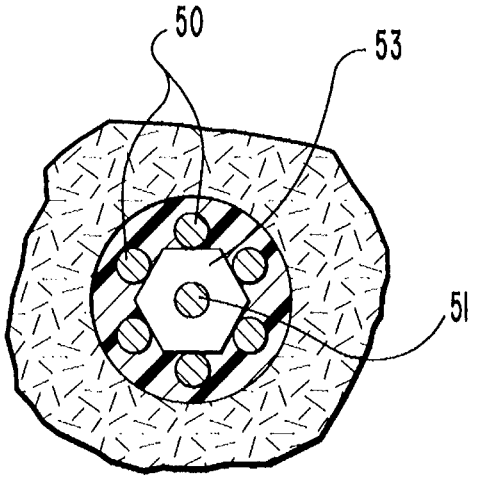
FIG. 5B is an enlarged section taken along the line 5B—5B in FIG. 4.
Figure 5C:
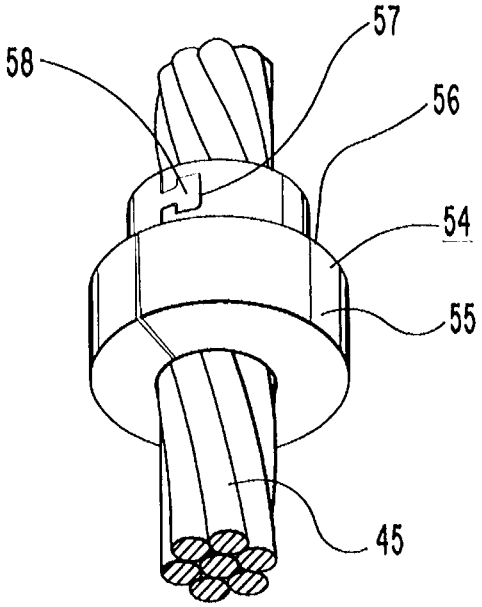
FIG. 5C is an enlarged detail, taken along the line 5C—5C, shown in perspective, and illustrating a resin dam element which is crimped and locked together on the cable illustrated.

FIG. 5B illustrates that cable section 49 may be constituted by simply securing a hex-sided spacer 53 about the kingwire 51 of the cable length. The strands at 50 will be spread apart, as seen, by the spacer's contiguous sides. As to the epoxy dam element 42, the same may be constituted simply by a split ring 55 having shoulder 56 as indicated, and provided with a T-slot at 57 and a T-extension 58 which fits into T-slot 57 upon the crimping of element 54 upon cable 37.

Figure 2:
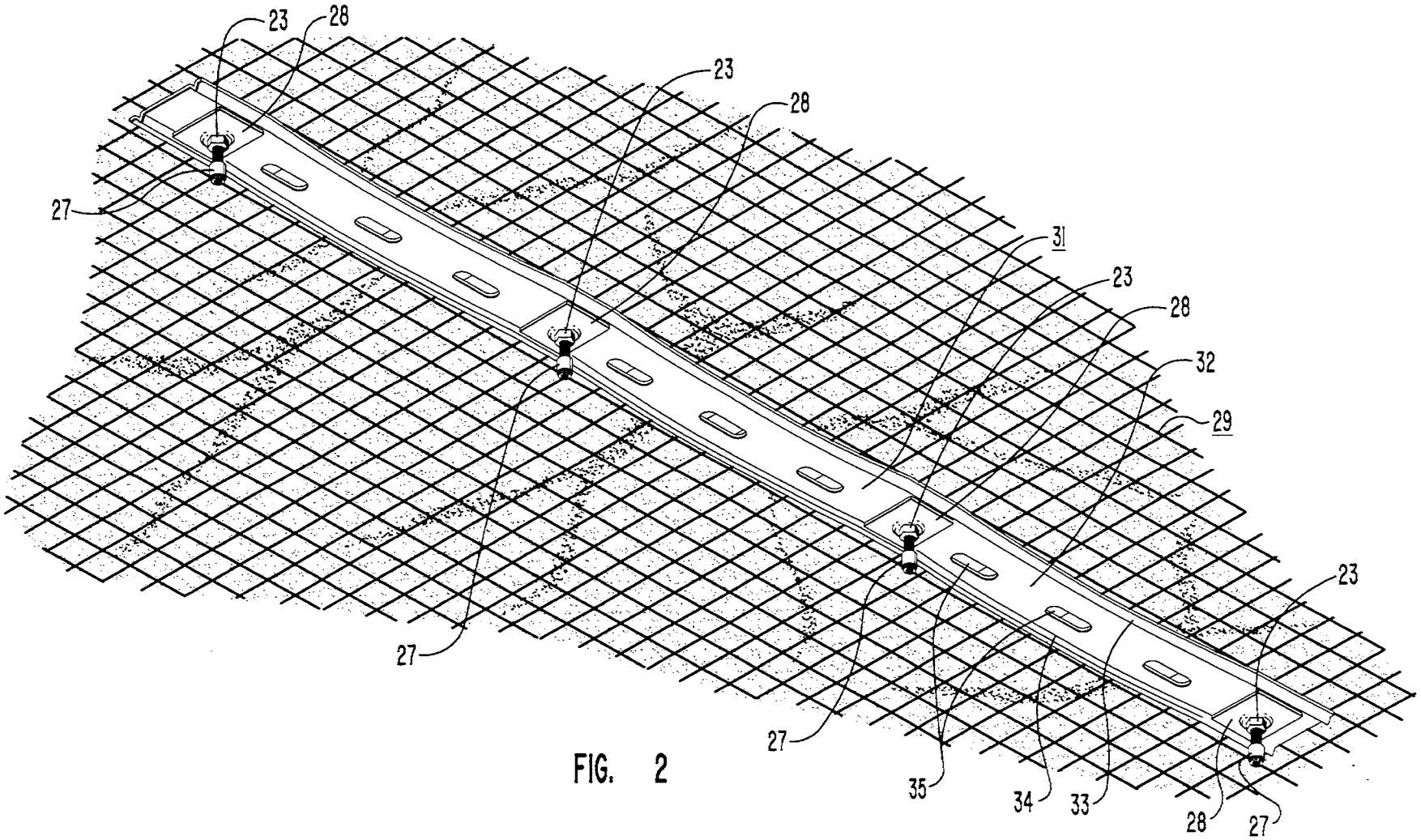
FIG. 2 is a perspective view taken along the line 2—2 in FIG. 1, illustrating in perspective the mesh and a representative mat which can be employed in supporting the roof surface of mine roof structure.
Figure 6:
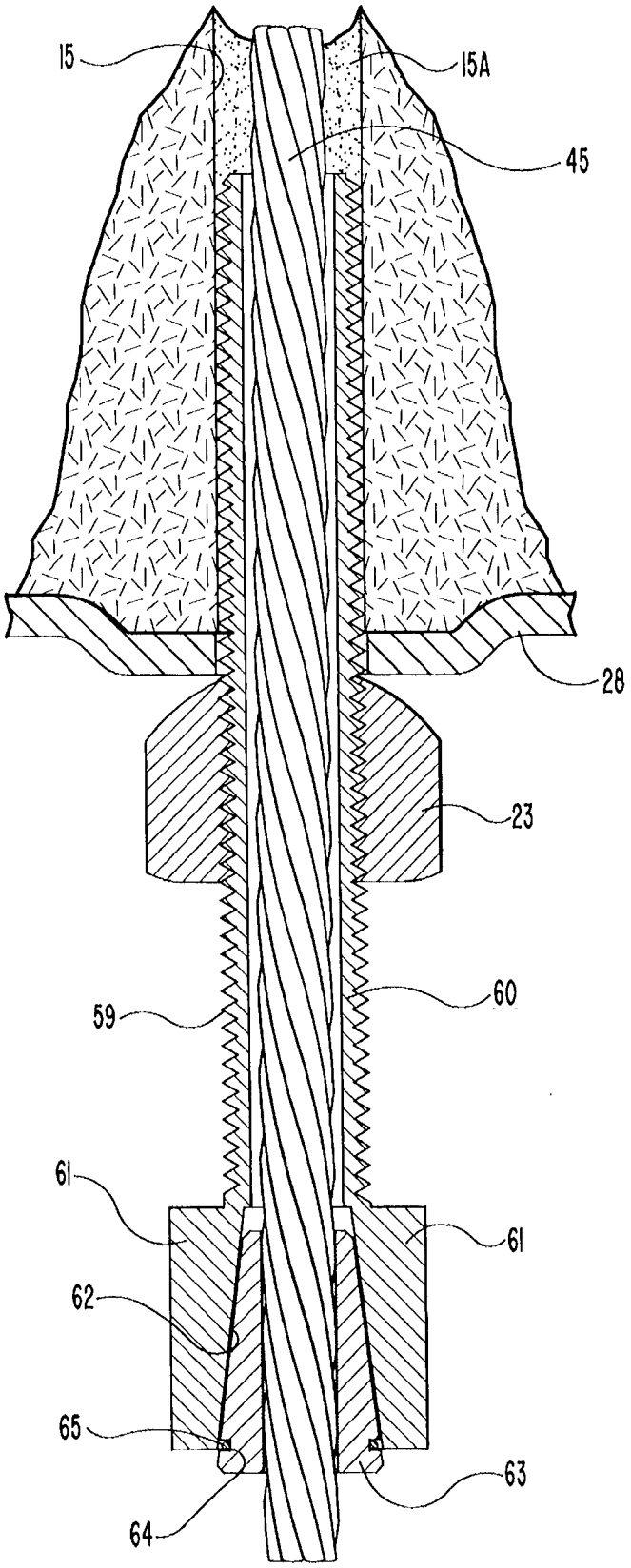
FIG. 6 is an elevation, shown in section, and illustrating the inner construction of a representative cable bolt as shown in FIG. 4, and as utilized herein.

A representative configuration of the lower portion of the cable bolt is seen in FIG. 6, also seen in FIG. 4. In FIG. 6 a bearing plate 28 is provided and is disposed either directly over the surface of the mine roof or is placed over the mat and mesh combination as seen in FIG. 2. In any event, a cable bolt tensioning nut 23 is supplied and is threaded over the threaded portion 59.

FIG. 6 illustrates that threaded portion 59 of threaded member 60, corresponding to member 40 in FIG. 4, receives and engages cable bolt tensioning nut 23 that is disposed over and bears against bearing plate 28 supporting the mine roof strata, whether directly by or by inter-imposed wire mesh and mat structure as hereinbefore explained. Threaded member 60 includes an enlarged head 61 provided with an internal tapered bore or receptacle 62 that receives a series of threaded jaws 63. These jaws may be retained in place by means of external grooves 64, relative to the jaws, that are aligned and receive a spring or rubber ring retainer 65, by way of example. The head 61 comprises an enlarged head for providing suitable wall thickness, where desired, for the conical, receiving structure surrounding the tapered jaws 63.

Figure 7:
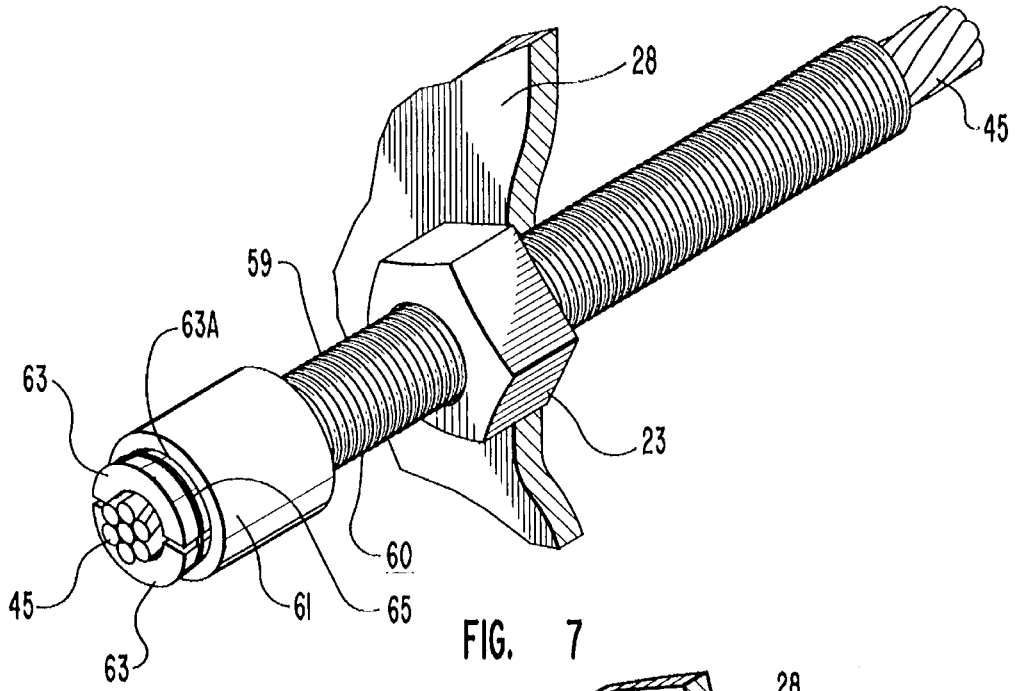
FIG. 7 is a perspective view, partially broken away, and illustrating in perspective the structure of FIG. 6.

In assembly the cable 45 will be disposed through the threaded member 60 as indicated in FIGS. 6, 7. Subsequently the tapered jaws, preferably having internal, part-cylindrical threads or teeth are employed to bite into and grip the external periphery of the cable. The greater the nut 23 is torqued against the bearing plate 28, the greater will be the tension on cable 45 and the greater the seating power of the jaws relative to the lower cable end within enlarged head 61.

Figure 8:
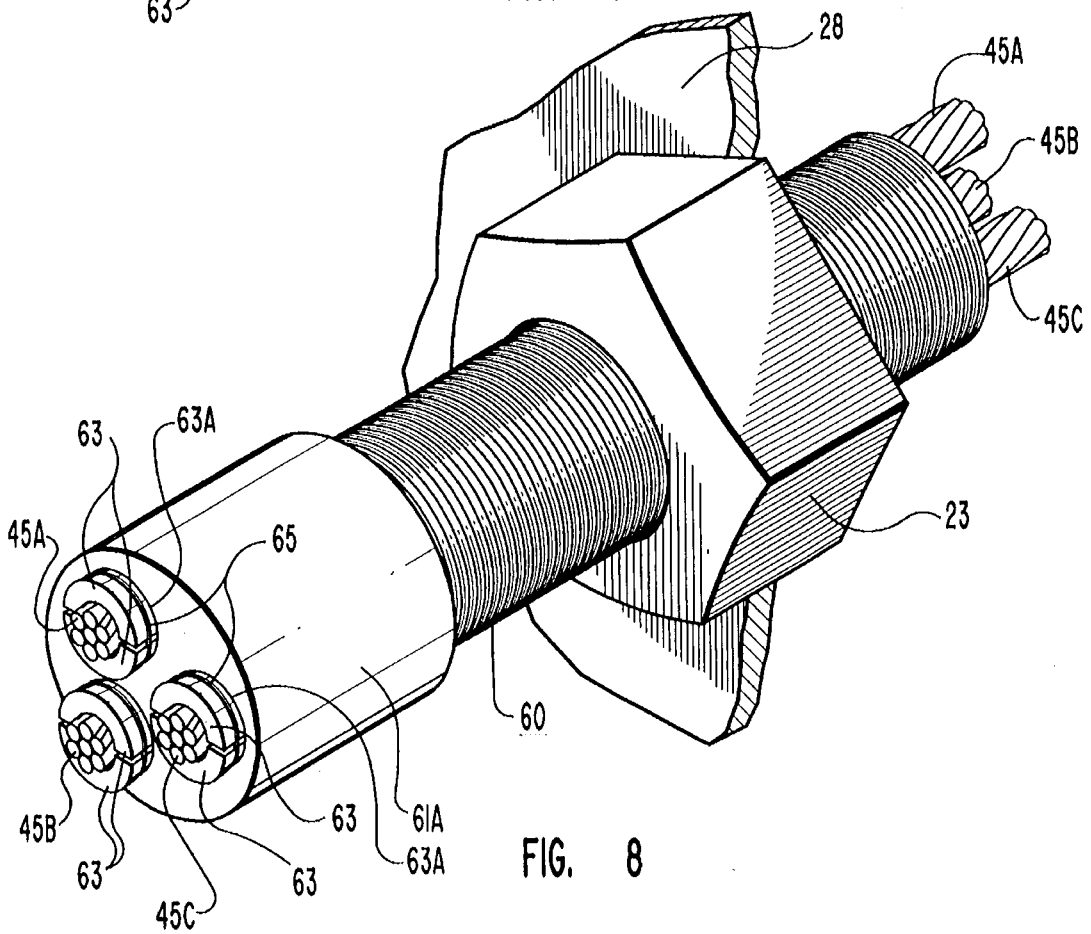
FIG. 8 is similar to FIG. 7 but illustrates a plurality of cables being employed in the cable bolt structure.

FIG. 8 illustrates a structure similar to FIG. 7 but wherein a series of cables 45A, 45B, and 45C are employed. In this instance the internal aperture of the bearing plate 28 can be enlarged as well as nut 23. This time the threaded member 60 will be enlarged in diameter and its enlarged head at 61A now provided with a series of internal apertures 63A, corresponding to aperture 62 in FIG. 6, which are outwardly tapered in a manner similar to the taper at 62 seen in FIG. 6. Accordingly, the series of cables 45A, 45B, and 45C will be held in place by their respective sets of jaws 63 in a manner similar to that shown with reference to a single cable as seen in FIG. 6.

Figure 9A:
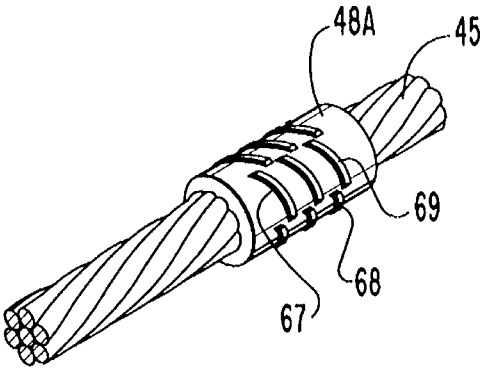
FIGS. 9A through 9F are fragmentary perspective details of respective cable sections having different types of elements crimped or otherwise secured thereto, such elements being utilized for mixing resin systems by their various shapes.
Figure 9B:
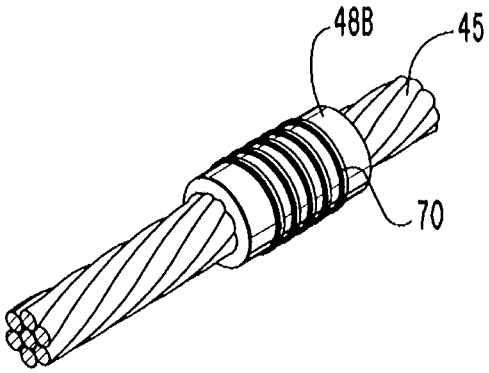
Figure 9C:
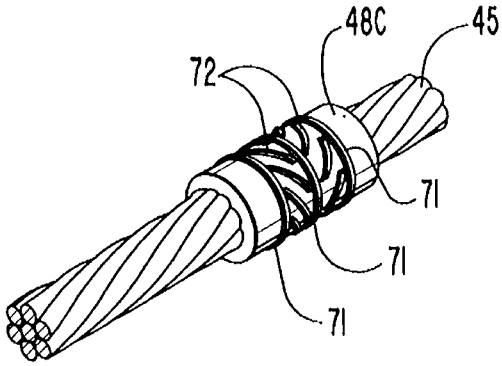
Figure 9D:
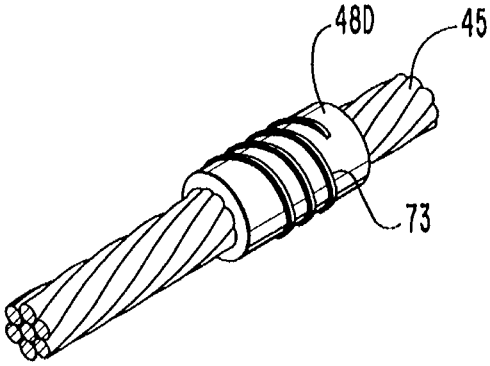
Figure 9E:
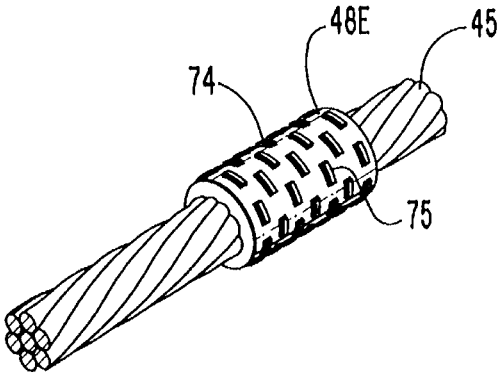
Figure 9F:
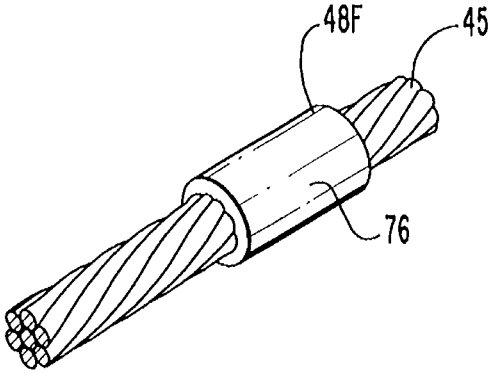

The epoxy mixing element or protuberance 48 in FIG. 4 may take any one of several forms as shown in FIGS. 9A–9F by corresponding elements 48A—48F, respectively. Again, these elements should be designed for optimum mixing of epoxy proximate with the upper ends of the respective cable bolts, as the cable bolts are thrust into the boreholes and spun, for epoxy mixing, so as to ensure the appropriate mixing and holding function of the epoxy for securement of such cable ends within the upper regions of the borehole. Element 48A, accordingly, includes a series of staggered, raised protuberances 67 which are segmented, the segments 68 and 69, for example, being offset relative to each other. In FIG. 9B the element 48B is provided with simply a series of raised mutually spaced rings 70. FIG. 9C illustrates another pattern wherein a series of rings 71 are separated by raised, angulated protuberances at 72 as shown. In FIG. 9D the element 48D is supplied simply with a helically formed protuberance at 73. In FIG. 9E there are a series of segmented protuberances seen at 74 and 75 which are disposed serially and in offset mutual inter-relationship. FIG. 9F illustrates an element 48F corresponding to element 48 in FIG. 4, but wherein the outer side is simply left smooth at 76.

Figure 10:
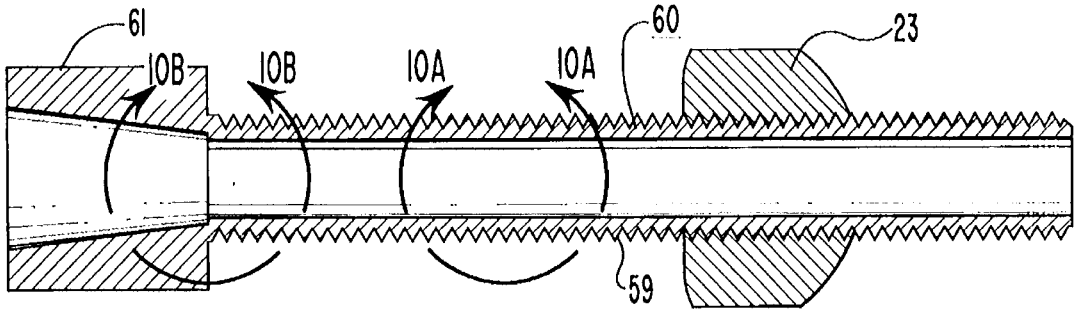
FIG. 10 is an elevation in section, illustrating one type of tubular body suitable for receiving cable gripping jaws and the cable to be disposed in such body.

FIG. 10 illustrates generically an elevation, principally in section, of threaded member 60 provided with nut 23 and enlarged head 61.

Figure 10A:
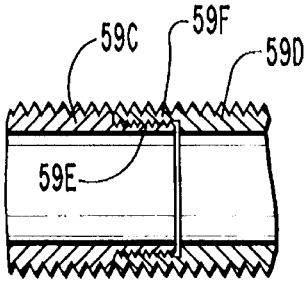
FIG. 10A is an enlarged detail taken along the arcuate line 10A—10A in FIG. 10, showing that the threaded tubular member provided can be fabricated and joined together in sections.

FIG. 10A illustrates that the threaded member can be segmented, having intercooperating threaded portions 59E and 59F which overlap, as seen, to provide for a threaded junction, thereby enabling multi-section elongation of the threaded member, as desired.

The purpose for the structure of FIGS. 10 and 10A is to illustrate that the threaded portions 59 may be segmented for a rectilinear joining of a series of externally threaded tubular parts. Thus, tubular portion 15, now termed tubular portion 59C in FIG. 10A, illustrates overlapping extremities 59E and 59F of the inner and outer tubes which are threadedly joined together to provide for an elongated structure relative to threaded member 60.

Figure 10B:
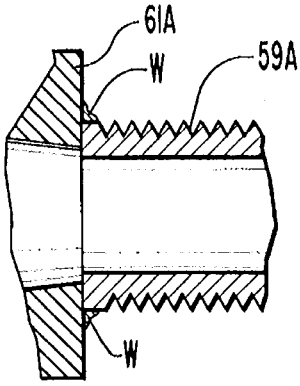
FIG. 10B is an enlarged detail, taken along the line 10B—10B in FIG. 10, showing that the enlarged head of the structure can be machined separate from but then welded to the threaded member of the construction.

FIG. 10B illustrates that the enlarged head 61 may take the form as seen at 61A, with the same being welded at W to tubular portion 59A, corresponding to threaded portion 59 in FIG. 10.

Figure 11:
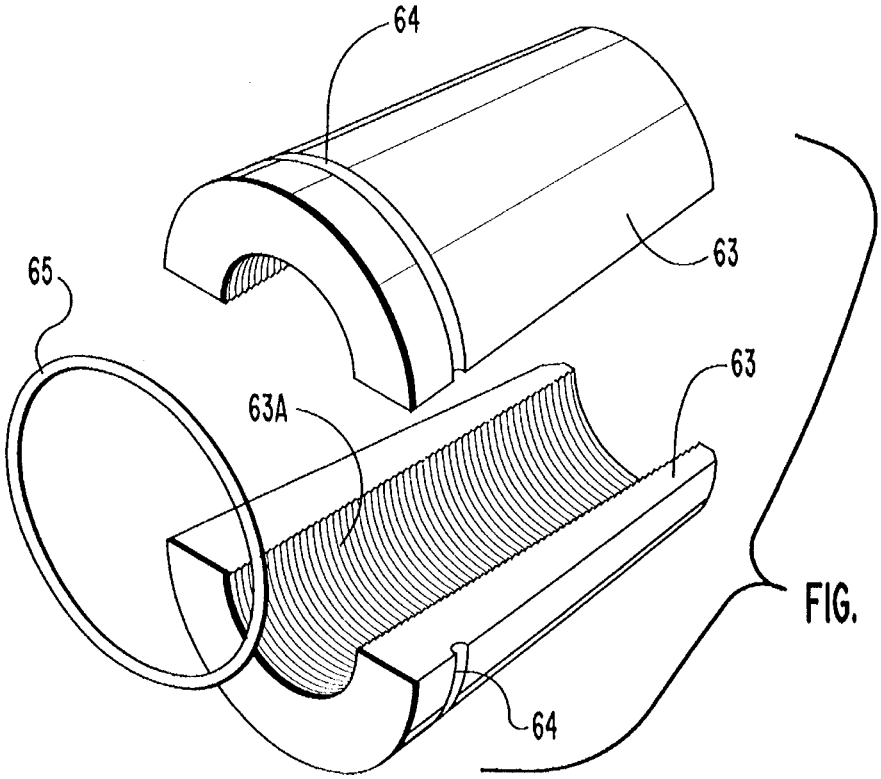
FIG. 11 is an exploded perspective view of a pair of jaws utilized with a retainer ring in gripping the cable element of the cable bolt.

In FIG. 11 a pair of hemi-conically tapered jaws 63 are illustrated in perspective, the same including serrations 63A on their respective interiors for gripping the cable length. These jaws are supplied with external grooves 64 accommodating the insertion of an elastomeric or metal tubular member or spring as at 65.

Figure 12:
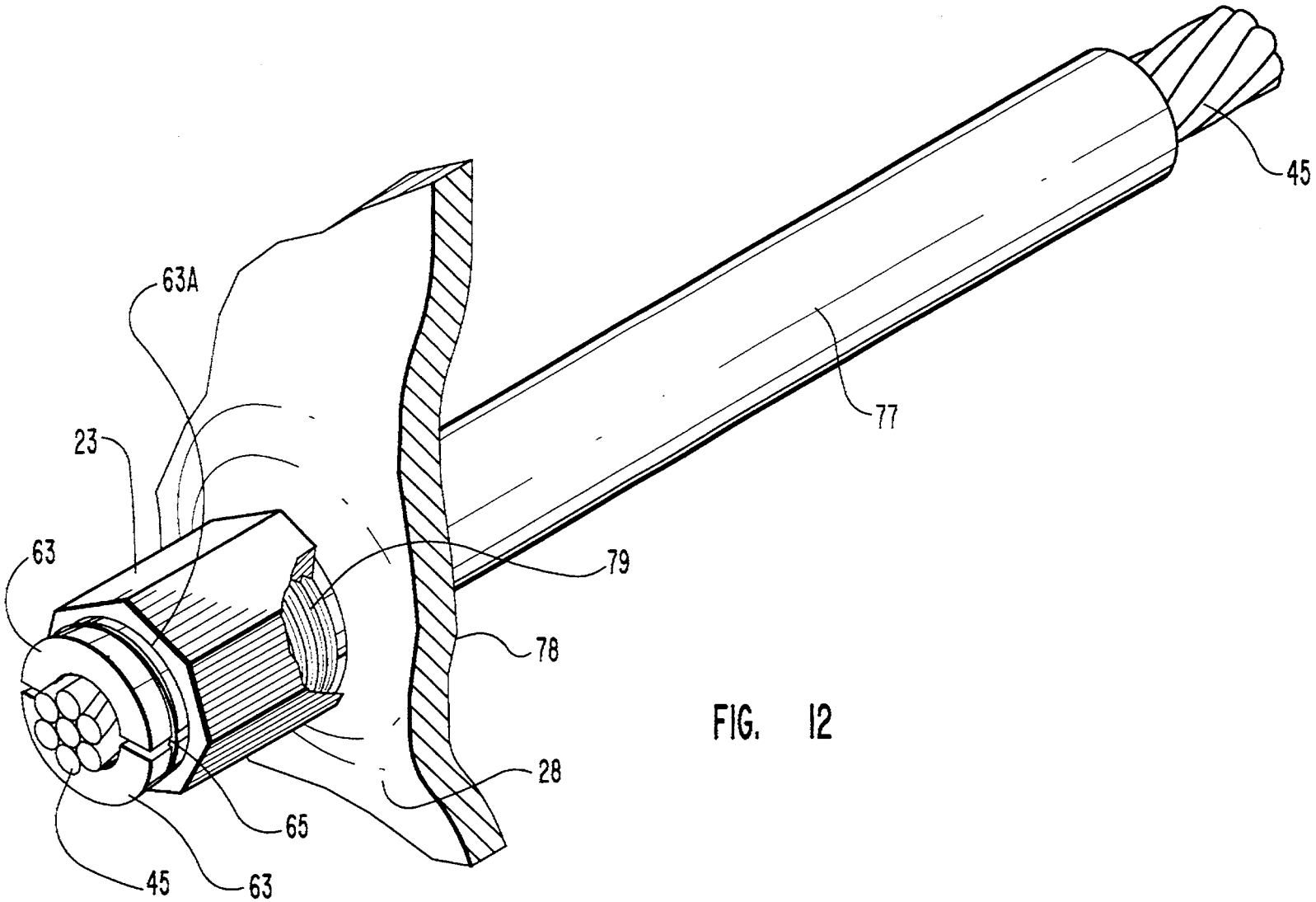
FIG. 12 indicates a passive cable bolt structure wherein the same is simply thrust upwardly into the borehole of mine roof strata and simply secured in place, by epoxy in the borehole, with the nut formed base portion thrusting against the bearing plate provided.

FIG. 12 illustrates the structure as previously described, with the cable 45 being held in place by jaws 63 as described in FIG. 11. This time nut 23 is threaded over a tubular portion 79 which is threaded to receive the interior threads of the nut. A loose tube 77 may be employed to serve as a liner for the borehole of the mine roof strata. The cable bolt is spun and thrust home, upwardly, with nut 23, of course, being positioned directly against bearing plate 78.

Figure 13:
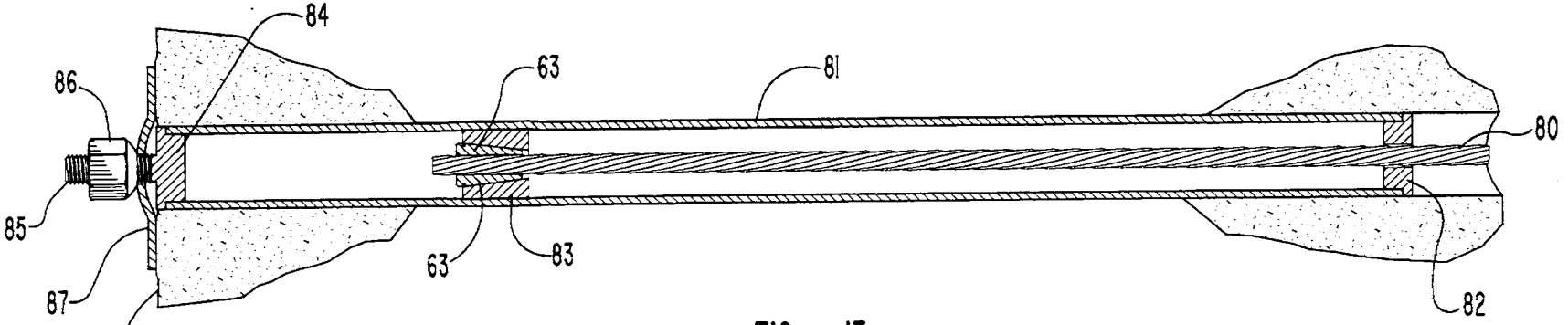
FIG. 13 is an elevation in section of an alternate cable bolt construction utilizing a controlled flexibility feature to accommodate roof strata settling, in a manner as hereinafter pointed out.

In FIG. 13 cable 80 is secured by jaws 63 within a piston-type element 83. The cable is guided through guide or cap 82 as indicated, the latter being secured to the upper or outermost end of tubular member 81 and serving as a stop for element 83. Lowermost end cap 84 is supplied with a threaded stub shaft 85 for receiving nut 86. Nut 86, of course, bears upon the bearing plate 87 which is thrust against the mine roof surface at 88.

Figure 14:
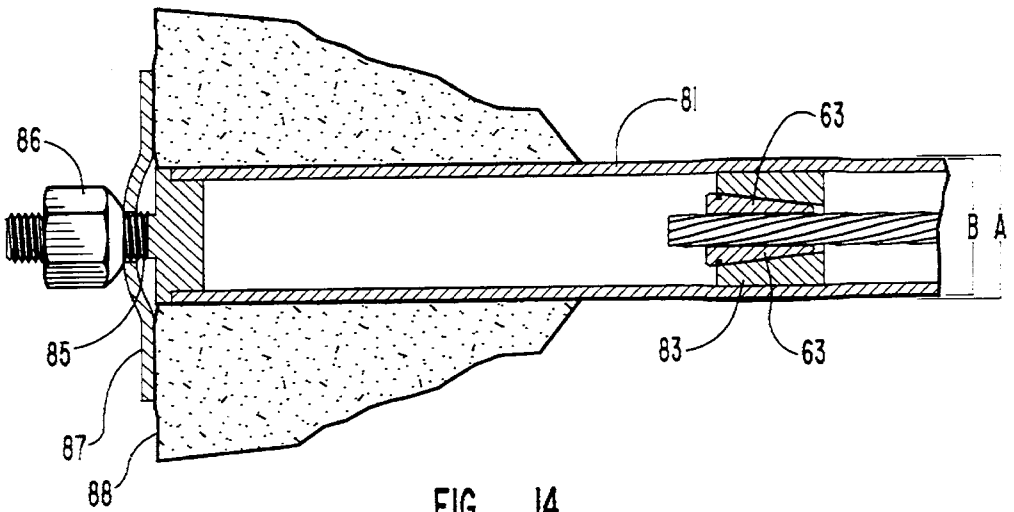
FIG. 14 is a sectioned detail of a portion of the cable bolt structure shown in FIG. 13, illustrating that as the piston-like member incorporated and utilizing the jaws proceeds along the interior of the external tubular member, there can be a slight deformity, see dimension A, generated radially outwardly relative to the nominal diameter, dimension B, in the conduit member so as to deter excessive piston travel and accommodate cable bolt adjustment.

In operation, the tightening of nut 86 supplies the tension to tube 81. A slight downward settling of the roof strata will produce a relative movement downwardly, i.e. to the left in FIG. 13, of tube 81. But since the piston-like member 83 will be designed to be oversized and have a substantial friction fit with the interior wall of tube 81, there will be a controlled descent and stabilization of the roof strata proximate surface 88. The interference fit between member 83 and member 81 can be sufficient such that there will be an actual deformation radially outwardly of the outer tube 81 as member 83 proceeds therein. Arrows A and B in FIG. 14 respectively indicate the enlarged deformation and also the nominal circumference of tube 81.

Figure 15:
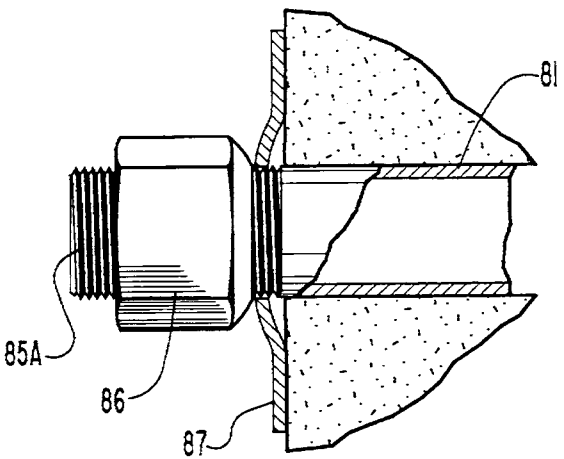
FIG. 15 is an enlarged detail, similar to the left side of FIG. 14 and illustrating an optional rearward end construction incorporating the torquing nut of the cable bolt structure.
Figure 16:
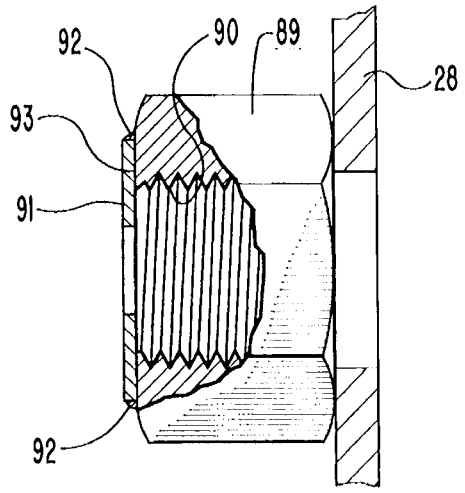
FIGS. 16–18 are side elevations of respective securement nuts which may be employed in conjunction with the cable bolt of the present invention; such nuts are cut-away in section for convenience of illustration.

FIG. 15 indicates that a single tubular member 81 can be employed in conjunction with the piston-like member 63, and the left end or downward end simply comprise a threaded portion of the tube as illustrated, with nut 86 engaging such portion of the tube. In FIG. 16 cable tensioning nut 89 has an internally threaded bore 90 and is provided with a washer element 91 that is lightly tacked as by welding 92 the rear surface 93 of the nut. This nut of course will thrust against a representative bearing plate 28 disposed against the mine roof surface.

In operation as to FIG. 16, when the nut 89 is threaded onto the cable bolt tubular member 44 in FIG. 4, by way of example, then the end of tube 44 will abut washer 91. Washer 91 likewise serves to keep in place jaws 63 in FIG. 6, by way of example. Furthermore, and most importantly, washer 91 in FIG. 16 provides that for moderate torques, the entire unit of the cable bolt will be twisted such that its upper end mixes the epoxy and is caused to become securely mounted in the borehole at its upper region. Further rotation in pronounced degree of nut 89 will cause the lower end of the tubular member of the cable bolt to eject washer 91, thereby allowing the nut 89, upon its continued rotation, to pull the cable bolt and its cylindrical conduit through the nut in pronounced degree to progressively tighten the cable.

Figure 17:
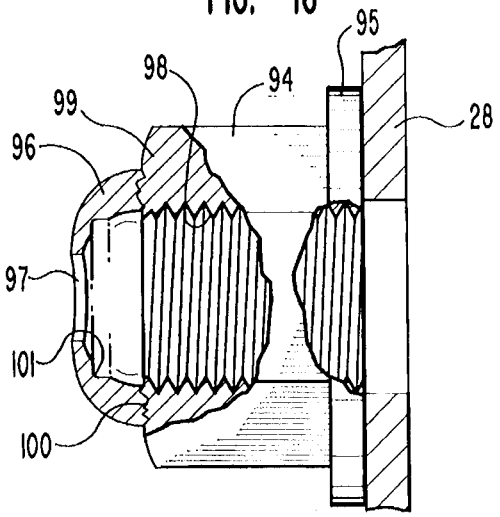

Nut 94 in FIG. 17 will operate in a similar manner. The same can resemble what is known in the art as a Frazier-Jones dome nut. This nut 94 includes a forward circular boss 95 and also a rear dome 96 having aperture 97 through which the cable will pass. The interior of dome nut 94 is threaded at 98, the dome 96 meets the body 99 of dome nut 94 in a frangible junction 100 such that when the rear of the cable bolt circular member engages annular shoulder 101 the dome 96 is caused to separate at juncture 100 and fall off. Thus, prior to the separation of dome 96 from the remainder of the nut, dome 96 will simply stop the continued rotation of the circular member of the cable bolt so that the rotation of nut 94 will produce a rotation of the entire cable bolt for mixing the epoxy as was explained in connection with FIG. 16. After the epoxy sets and the cable no longer has the ability to turn, then the continued rotation of nut 94 will cause the separation of dome 96 so that the threaded circular member of the cable bolt can proceed through nut 94 to enable the cable bolt to become tightened.

Figure 18:
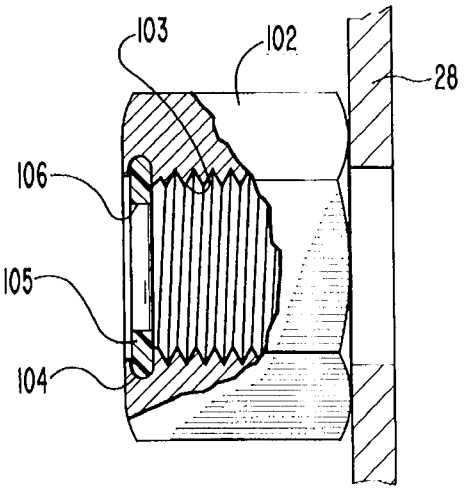

FIG. 18 is still another type of nut that can be employed, illustrating nut 102 as having an internally threaded bore 103 and provided with an annular pocket 104 receiving nylon washer 105. The inner annular edge 106 of washer 105 defines an aperture of less circumferential dimension than the threaded bore at 103. Accordingly, the threaded member of the cable bolt such as threaded member 44 in FIG. 4 will thrust against the washer and the washer will keep further threaded progression from occurring until substantial torque is produced. Thus, as an initial condition, the abutting of threaded member 44 against washer 104 will enable the entire unit to be turned, by supplying a wrench or other fitting engaged at 102 so that the cable bolt can be spun about its axis, thereby mixing the epoxy as above mentioned immediately prior to epoxy securement of the cable upper end in the borehole. Once the epoxy sets, then increased torque is applied at 102 so as to cause the washer 104 either to break or fall out of its seat, thereby allowing the nut 102 to be advanced relative to threaded member 44 in FIG. 4 for applying progressively increasing tension to the cable. As mine strata conditions alter, tensioning nut can be backed off for incrementally reducing such tension, as may be desired to prevent failure. In FIGS. 16–18 elements 93, 96, and 105 thus serve as temporary stop elements relative to the lower threaded end of the cable bolt construction.

Figure 19:
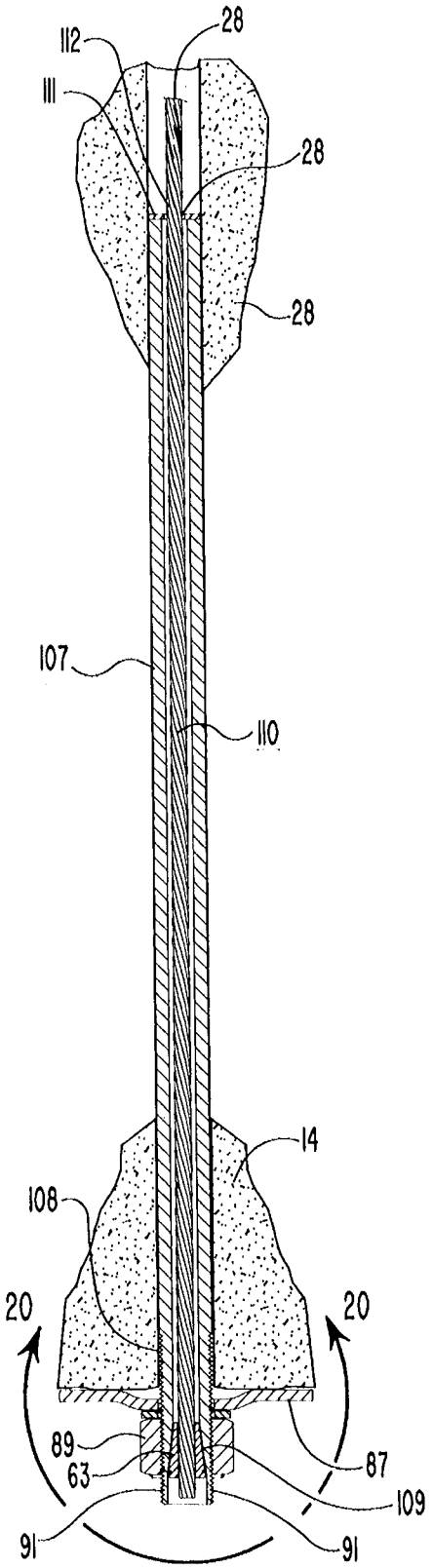
FIG. 19 is an elevation, shown principally in section, of another type of cable bolt structure which can be utilized in the invention.
Figure 21:
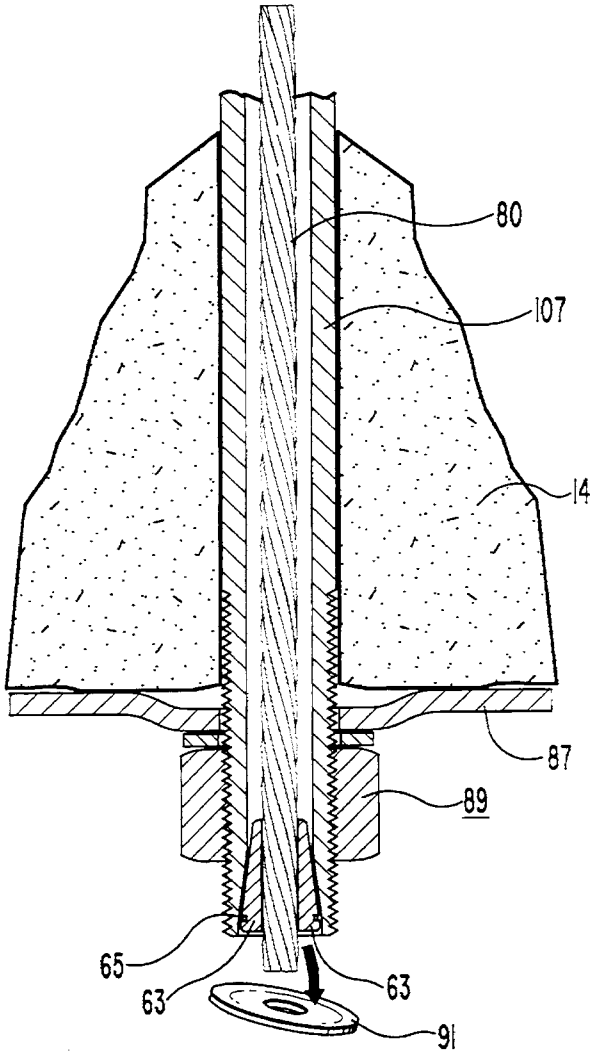
FIG. 21 is similar to FIG. 20 but illustrates that upon further torquing of the tensioning nut, the washer or other stop element associated with the nut drops off as the tensioning of the cable of the structure is progressively increased.
Figure 20:
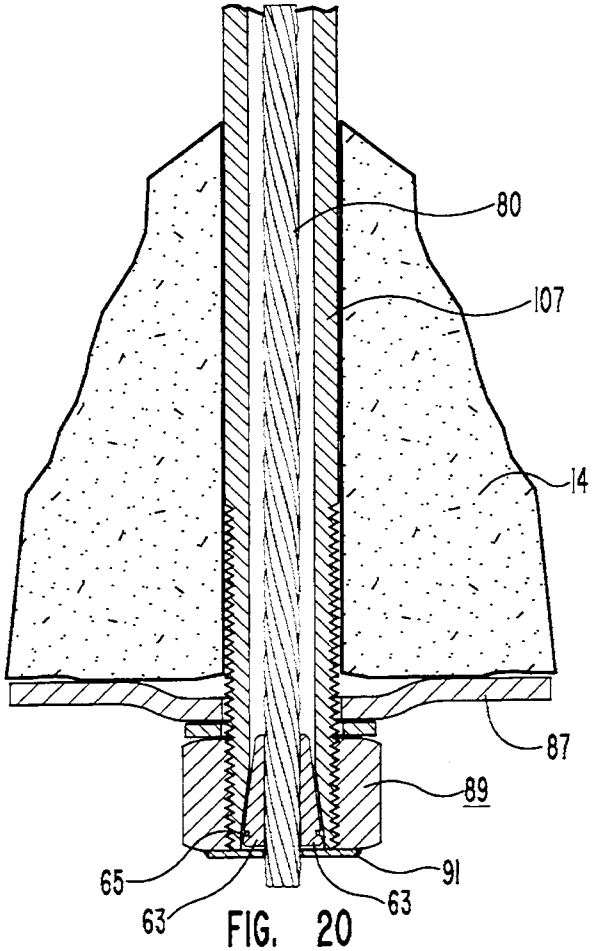
FIG. 20 is an enlarged detail taken along the arcuate line 20—20 in FIG. 19.

In FIG. 19 the cable bolt 110 includes a tubular member 107 having a threaded end 108 of perhaps 4 to 6 inches in length. Tubular member 107 also includes a tapered conical seat 109 for receiving jaws 63 with this retainer ring as hereinbefore explained. The tubular member may or may not have an end bushing or cap 11 apertured at 112 for receiving cable 80. Cable 80, at its lower end in FIG. 19, is gripped by the jaws 63 and in the manner herein before described. One of the nuts as seen in FIGS. 16–18, e. g., nut 89 is provided and is secured onto the threaded end of tubular member 107. The washer 91 abuts the inner ends of the jaws. As the nut is tightened the tubular member 107 advances progressively downwardly so as to enable a tensioning by such action of cable 80. This action is clearly seen in FIGS. 20 and 21; FIG. 20 illustrates the case prior to separation of washer 91 from nut 89, FIG. 21 illustrating the condition subsequent to separation of washer 91 from nut 89 by the downward advancement of tube 107. Again, in FIGS. 19 and 20 the washer abuts the lower surfaces of the jaws. Further, in the condition shown in FIG. 20, a torquing tool grips nut 89 and spins the entire unit consisting of tube 107 and cable 80 in addition to the cable retention jaws 63. This mixes the epoxy and causes the upper end of the cable to become fixed in its mount. After this is achieved, the subsequent rotational advance of nut 89 causes the washer 91 to break off and fall away, thereby permitting a progressive descent of tube 107 as the nut 89 is further tightened.

Figure 22:
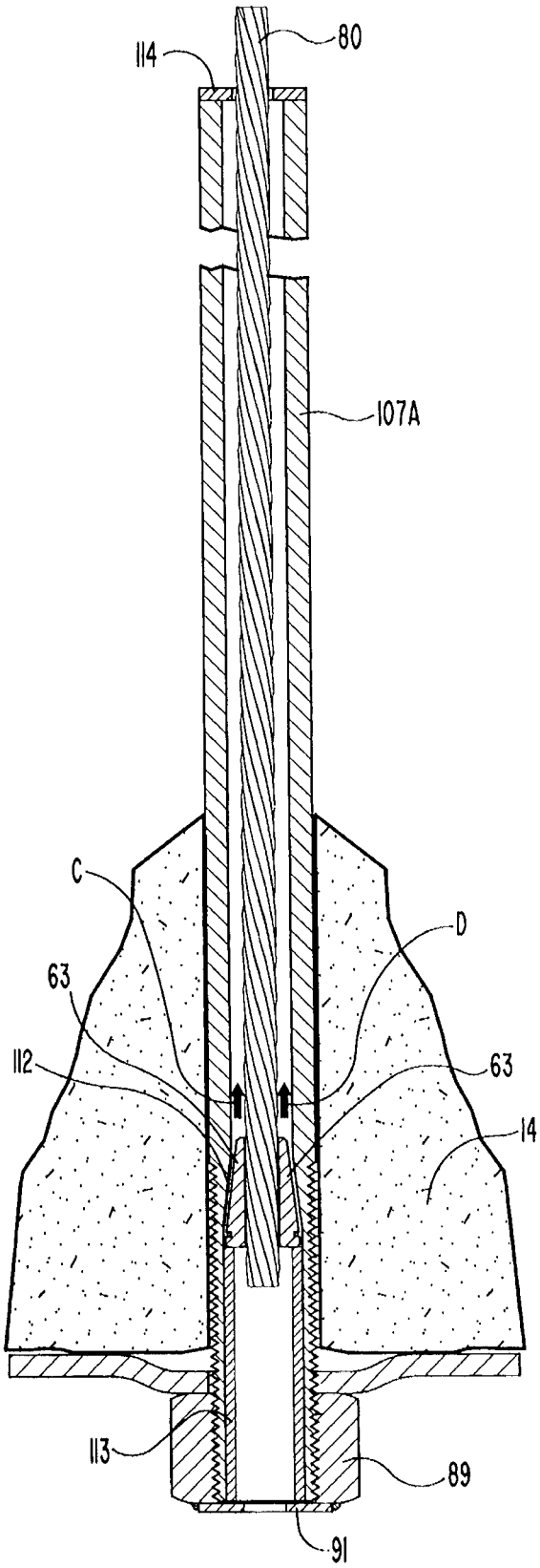
FIG. 22 is an elevation shown in section, showing another optional form of cable bolt structure wherein the cable gripping jaws are permitted to advance within the tubular member of the structure so as to provide a moving pressure bubble in accordance with either the taking-up of the tension nut of the structure or the settling of the mine roof strata.

In FIG. 22 a tubular member 107A corresponds to tubular member 107 in FIGS. 20 and 21. This time, tubular member 107A has a medially positioned conical taper 112 receiving jaws 63 and their assembly. Accordingly, the lower portion of tubular member 107A, i.e. to the left of jaws 63, is machined to have a greater diameter than the diameter of the same above the tapered seat at 112, i. e., to the right of jaws 63. A tube 113 may be provided and disposed between the washer of nut 89 and the lower edges of jaws 63 this is tube 113. The nut will be used again for spinning the cable bolt to anchor the upward end of cable 80 in the epoxy at the upper end of the borehole. Subsequent pressure will cause washer of the nut to drop off and hence the threaded tubular member will advance downwardly upon further hard rotation of nut 89. The material of the threaded tubular member can be so chosen in relation to the jaws that the jaws actually will advance upwardly as shown by the arrows C and D to cause in effect a pressure bubble to occur, tending to restrain a relative advance of the cable and its jaws relative to threaded member 107A. Accordingly, a slight relief feature is presented. Stop member 114 can be provided so that once the jaws engage the stop member, secured to threaded tubular member 107A, then any further settling of mine roof strata will cause the cable to fail, at this point a condition to be desired.

Figure 23:
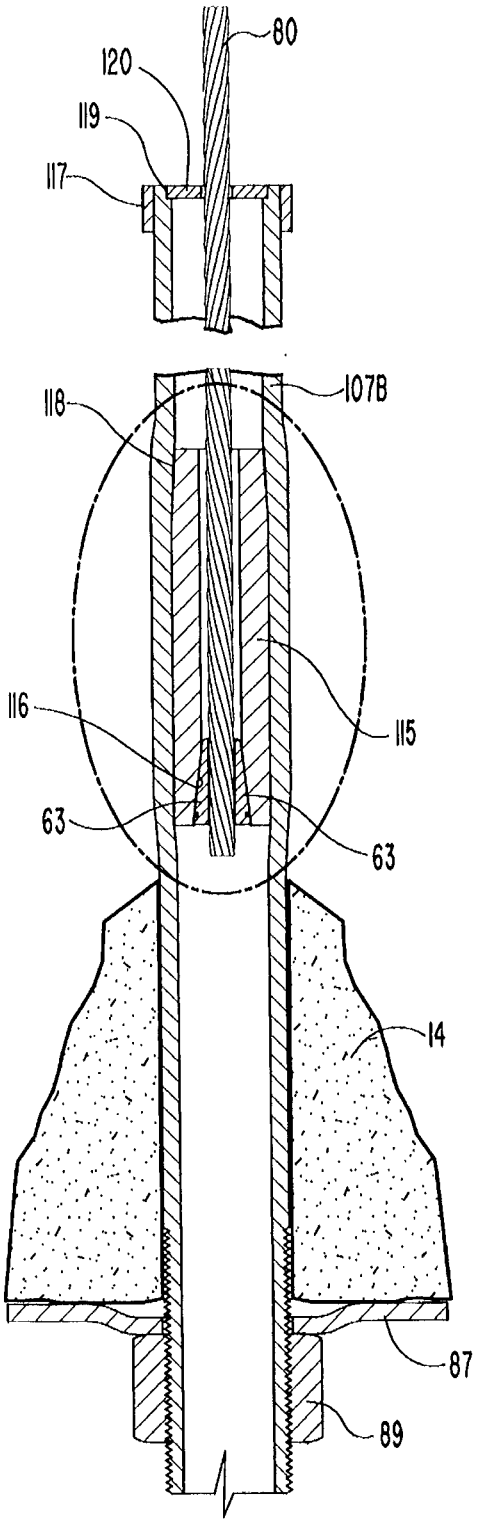
FIG. 23 is similar to FIG. 22 but illustrates an optional construction wherein a piston-like tube receives the jaws gripping the cable of the cable bolt, the piston-type tube being in interference fit relationship with the outer threaded tube of the structure whereby to provide a pressure bubble, so as to allow for automatic adjustment of the condition of the cable bolt in response to slight settling of mine roof strata and/or adjustment of the cable tensioning nut provided.

FIG. 23 is similar to FIG. 22 but illustrates an alternate embodiment wherein, disposed within tubular member 107B, corresponding to member 107A in FIG. 22, there is provided a piston-type tube 115 having inner conical seat 116 which seats the respective jaws 63. The outer circumference of piston-type tube 115 is oversized relative to the nominal inner diameter of tube 107B. If desired, there may be supplied a chamfered or tapered end at 118. The piston 115 thus cooperates with tubular member 107B in an interference fit, and may be initially installed under pressure or simply installed at the installation site. As tubular member 107B is advanced downwardly through the torquing of nut 89, the friction bubble generated by the interference fit between piston 115 and tubular member 107B will advance upwardly. Where tubular member 107B has a longitudinal side wall seam, then the tendency for the tube to split apart will be eliminated through the inclusion of a collar 117 which is thrust over and secured to end 119. Stop member 120 can be included to finally arrest the advance of the piston-type tube 115, wherein further tensioning of the cable will produce a breakage of the cable owing to excessive tension over its tensile strength, and this is what is wanted upon aggravated settling of mine roof strata.

In operation, and in all of the embodiments herein, the nut may be tightened to increase tensioning of the cable and also progressively backed off so as to control the degree of cable tension. The pressure bubble provided, see FIGS. 22 and 23, indicate a certain flexibility so as to enable a certain "give," whereby to accommodate too great a tension of the cable to occur, owing to settling even in the absence of rearward adjustment of nut 89. This back-off feature serves to readjust tension of the cable bolt.

Figure 24:
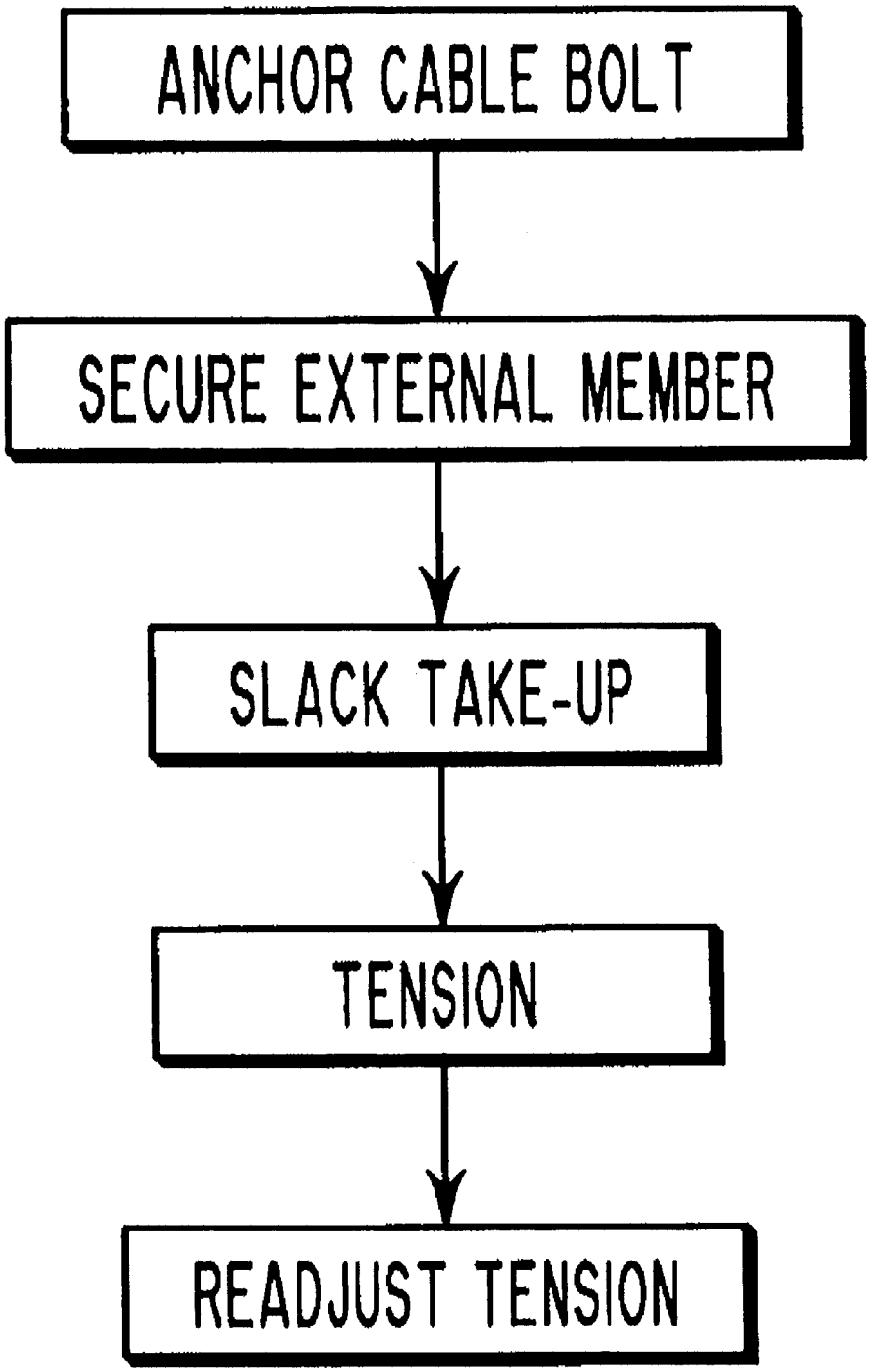
FIG. 24 is a block diagram of the method of the present invention.

FIG. 24 indicates the method inherent in the present invention which is to provide a cable bolt having a cable length with a remote end constructed for anchoring in a mine roof borehole and also a proximate end; providing said proximate end with an external threaded sleeve anchored thereto and a tension adjustment nut threaded onto said sleeve; providing a reaction member for disposition over an external mine roof surface, said adjustment nut cooperating with said reaction member, applying torque to said adjustment nut, whereby at a preset tension in said cable bolt to a desired level within a given range in accordance with initial conditions of proximate mine roof strata, and re-adjusting said nut in accordance with any degree of settling of mine roof strata, whereby to retain a desired degree of tension in said cable bolt within a given range. FIG. 24 illustrates in block diagram abbreviated form of the method above described, including (1) providing an anchor, i.e. cable bolt, for mounting in a borehole, (2) securing a external member, i.e. a tensioning nut, to the anchor, (3) taking up slack through initially tightening the nut, then (4) tensioning the cable bolt or anchor through increased advancement of the nut relative to the cable bolt, and finally (5) readjusting the tension of the cable bolt by backing-off, incrementally, the tensioning nut and/or utilizing an interference-fit pressure bubble technique, see as to the pressure bubble principle in general the co-inventor's issued U.S. patents which are fully incorporated herein by way of reference, i.e. U.S. Pat. Nos. 5,015,125 and 5,215,411, whereby to allow incremental tension reduction in the cable bolt in accordance with existing load conditions.

While particular embodiments of the present invention have been shown and described, it will be obvious to those skilled in the art that various changes and modifications may be made without departing from the essential features of the invention and therefore, the aim of the appended claims is to cover all such changes and modifications as fall within the true spirit and scope of the invention.

We claim:

1. In combination, a cable length having a proximate end and also a remote end for securement within mine roof strata borehole; a threaded tubular member disposed over at least a portion of said cable length and having a threaded proximate end and a remote end, said tubular member having a first open interior of a first transverse size proximate said proximate end, a second open interior of smaller transverse size proximate said remote end, and a conically tapered seat interposed between said first and second open interiors; jaw means initially disposed at and fitting in said tapered seat and gripping said cable length; and nut means threaded onto said tubular member for yieldingly tensioning said cable in advancing said jaw means beyond said seat in an interference-fit, pressure bubble relationship with respect to said threaded tubular member at said second open interior thereof.

* * * * *